US006907852B2

(12) United States Patent
Schleusener et al.

(10) Patent No.: US 6,907,852 B2
(45) Date of Patent: Jun. 21, 2005

(54) VALVE OPERATING DEVICE FOR VARIABLE STROKE ADJUSTMENT OF A CHARGE EXCHANGE VALVE OF AN INTERNAL COMBUSTION ENGINE

(75) Inventors: Michael Schleusener, Munich (DE); Rudolf Flierl, Kaiserslautern (DE)

(73) Assignee: Bayerische Motoren Werke AG, Munich (DE)

( * ) Notice: Subject to any disclaimer, the term of this patent is extended or adjusted under 35 U.S.C. 154(b) by 0 days.

(21) Appl. No.: 10/704,118

(22) Filed: Nov. 10, 2003

(65) Prior Publication Data

US 2004/0144347 A1 Jul. 29, 2004

Related U.S. Application Data

(63) Continuation of application No. PCT/EP02/04332, filed on Apr. 19, 2002.

(30) Foreign Application Priority Data

May 12, 2001 (DE) ..... 101 23 186

(51) Int. Cl.[7] ..... F01L 1/34

(52) U.S. Cl. ..... 123/90.16; 123/90.17; 123/90.39; 123/90.44; 123/90.48

(58) Field of Search ..... 123/90.15, 90.16, 123/90.17, 90.25, 90.26, 90.27, 90.39, 90.43, 90.44, 90.45, 90.46, 90.48, 90.52, 90.55, 90.6, 345, 346

(56) References Cited

U.S. PATENT DOCUMENTS 4,151,817 A * 5/1979 Mueller ..... 123/90.16
5,203,289 A * 4/1993 Hara et al. ..... 123/90.16
5,655,488 A * 8/1997 Hampton et al. ..... 123/90.16
6,085,704 A * 7/2000 Hara ..... 123/90.11
6,481,399 B1 * 11/2002 Morrn ..... 123/90.16

FOREIGN PATENT DOCUMENTS

| | | |
|---|---|---|
| DE | 26 29 554 A1 | 1/1978 |
| DE | 42 23 172 C1 | 8/1993 |
| DE | 195 09 604 A1 | 9/1996 |
| DE | 197 08 484 A1 | 9/1998 |
| DE | 189 13 742 A1 | 9/2000 |
| EP | 1 096 115 B1 | 7/2002 |
| GB | 2 298 899 A | 9/1996 |
| WO | WO 98/03778 | 1/1998 |

OTHER PUBLICATIONS

International Search Report (PCT/EP 02/04332).

* cited by examiner

*Primary Examiner*—Thomas Denion
*Assistant Examiner*—Ching Chang
(74) *Attorney, Agent, or Firm*—Crowell & Moring LLP

(57) ABSTRACT

In a valve-driving device for variable adjustment of the lift of a gas exchange valve of an internal combustion engine, wherein the gas exchange valve co-operates, via a transfer element, with a roller which can move about an axis of rotation, with a control path having an idling lift curve and a lift curve in an end area of a spring-loaded pivoting level which is controlled by a cam associated with a cam shaft in order to actuate the lifting of said gas exchange valve. In order to obtain a pure pivoting movement of the pivoting lever, the pivoting center of motion forms a constant instantaneous center of rotation during any actuation of said lift. In order to prevent an impact arising from the valve clearance, the control path of the pivoting lever comprises a ramp, which is correspondingly adapted to the respective valve clearance, between the idling lift curve and the lift curve.

12 Claims, 1 Drawing Sheet

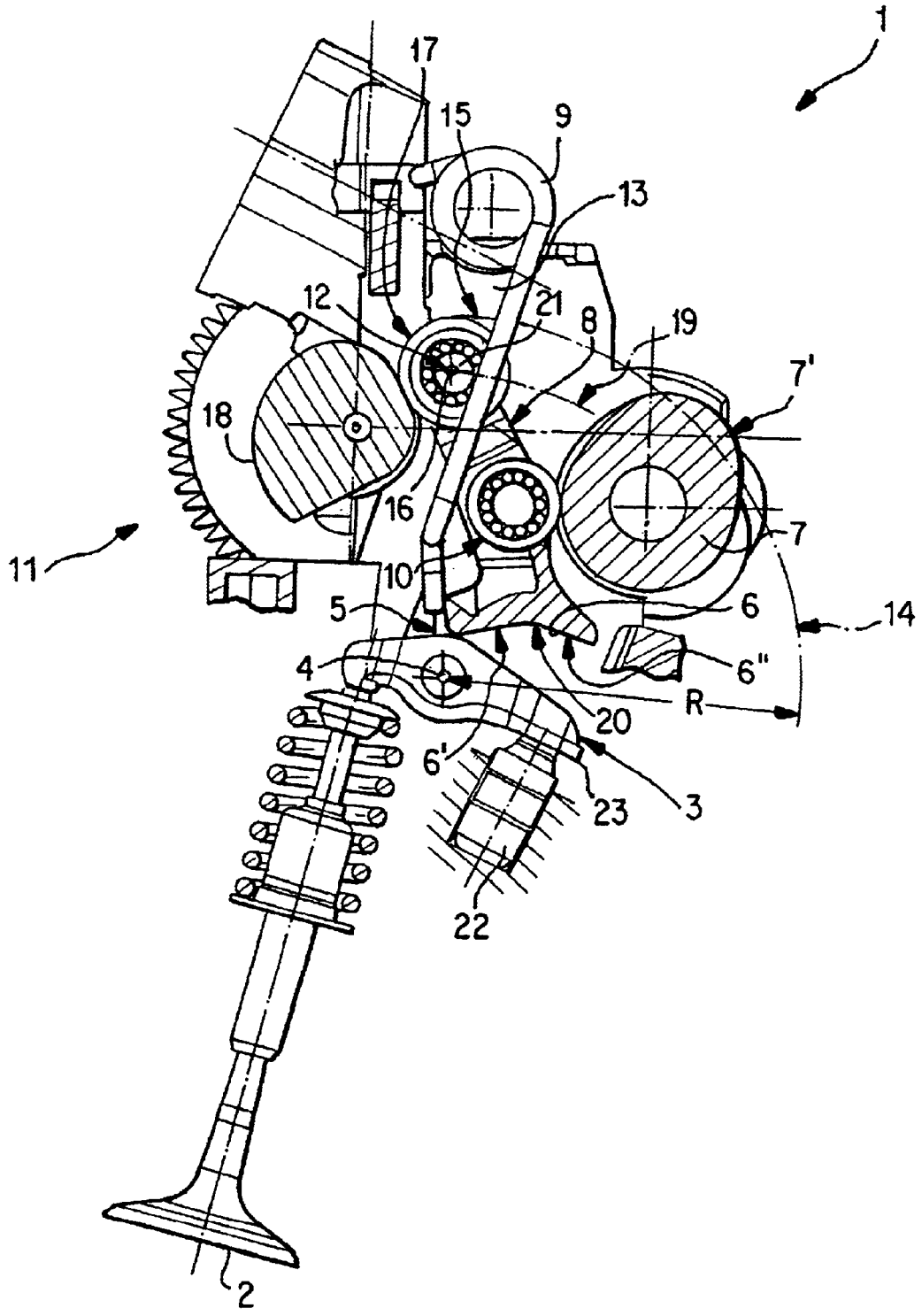
1
17
15
9
13
12
21
8
19
7'
18
16
7
11
10
5
6
14
4
6"
R
20
6'
23
3
22
2

VALVE OPERATING DEVICE FOR VARIABLE STROKE ADJUSTMENT OF A CHARGE EXCHANGE VALVE OF AN INTERNAL COMBUSTION ENGINE

CROSS REFERENCE TO RELATED APPLICATIONS

This application is a continuation of international patent application no. PCT/EP02/04332, filed Apr. 19, 2002, designating the United States of America, and published in German as WO 02/092972, the entire disclosure of which is incorporated herein by reference. Priority is claimed based on Federal Republic of Germany Patent Application No. DE 101 23 186.5, filed May 12, 2001.

BACKGROUND AND SUMMARY OF THE INVENTION

The invention relates to a valve operating device for the variable adjustment of the stroke of a charge exchange valve of an internal combustion engine, wherein the charge exchange valve is in active connection with a wheel rotatable about an axis of rotation, with the interposition of a transfer element, having a control path, comprising an idle stroke track and a working stroke track, in an end portion of a lever operated by a cam of a camshaft for lifting the charge exchange valve, wherein the lever associated under spring thrust with the cam on a curved path is supported at the other end along an arcuate path for variable stroke adjustment through a pivot point that is variable in position and fixable.

A valve operating device of this kind is disclosed in DE 197 08484 A1, wherein the lever has, in its end area remote from the control path, an arcuately shaped set of teeth for engagement in teeth of a control shaft which serves as an adjustment device for varying the fulcrum position associated with a particular stroke of the charge exchange valve. The pivot point of the lever is located in this case at the point of contact with the reference circles.

With this arrangement, when the cam of an adjacent camshaft acts upon the lever, it is brought about that the latter rolls in the teeth of the stationary control shaft and at the same time, in addition to a turning movement or rotatory movement with respect to the wheel of the transmission element, a translational component of movement also occurs with the circumstance of a stroke of the charge exchange valve at variance with the intended stroke.

Another, similar valve operating device is furthermore disclosed in DE 42 23 172 C1, wherein the lever that is turned by the cam of a camshaft to achieve a variable stroke—zero stroke to full stroke—is guided by a lever turned by the cam of a camshaft at its free end adjacent to linear contact with a cam serving for stroke adjustment through a slot on a pivot pin affixed to the housing. Even in this guidance method, in case of an operation of the charge exchange valve, the lever is subjected at its pivot point to a rotatory as well as linear component of movement, while the linear component of motion corresponds to the operation of a preliminary cam or a ramp, but otherwise it acts against any increase in the dynamic of the valve operation.

The invention is addressed to the problem in the generic valve operating device, to improve a lever cinematically such that it will permit a greater valve operating dynamic in a purely rotational movement or swinging movement.

This problem is solved by the invention described and claimed hereinafter by the fact that a circular track arranged on a part of the housing of the internal combustion engine serves as a slide with a radius "R" about the axis of rotation of the wheel of the transfer element of the position-variable support of the lever, while the guidance path of the lever is formed in the area of transition between the idle stroke cam and lifting cam with a ramp set for a valve clearance in the valve operating device.

With the invention the advantage is achieved that the pivot point of the lever during the lifting action for a preset valve lift forms an invariable momentary pole and thus any translational component of movement is advantageously prevented. On this basis of the invention the time required for changing the stroke of the charge exchange valve can be reduced to a substantially greater extent, and retarding of the opening and closing sections during partial strokes is largely eliminated. Furthermore, the invention provides a valve operating device of great stiffness, which is furthermore advantageous towards greater valve acceleration. Lastly, the valve operating device of the invention permits an actual zero stroke and an increase of torque by the full opening of the charge exchange valve, combined with great strength at high speeds.

In a preferred embodiment of the invention it is proposed that the lever is supported at its end remote from the control track by a wheel which can rotate about an axis, against the circular path or slide and can be fixed each time by the adjusting system such that the wheel's axis, which can be shifted under control along a path equidistant from the circular orbit, forms the lever's pivot point serving for the particular variable stroke adjustment.

In conjunction with an additional proposal, according to which the circular-path wheel of the lever is to be arranged on needle or roller bearings on a stub shaft affixed to the lever, with the momentary pole or pivot point shifting according to the invention to the axis of the circular-path wheel of the lever, the result is a valve operating device of reduced wear with substantially less friction and high accuracy of operation, while furthermore the energy required for the adjusting system is advantageously reduced.

According to an additional preferred embodiment, a wheeled idler arm supported on the side of the housing by a hydraulic valve lifter is provided, while the ramp provided to compensate for the eliminated linear movement component is designed for a substantially constant stroke speed with a maximum stroke exceeding the greatest possible valve clearance.

Additional possibilities for the configuration of the transfer element are: formation as a tappet with a wheel, or formation as a lever with a mechanically adjusted valve clearance.

BRIEF DESCRIPTION OF THE DRAWING

The invention is described with the aid of an embodiment represented in the FIGURE.

DETAILED DESCRIPTION OF THE DRAWING

A valve operating device 1 according to the FIGURE serves to produce the variable valve lift of a charge exchange valve 2 of an internal combustion engine (not shown). The charge exchange valve 2 is one of several identical intake valves of a cylinder of the internal combustion engine. In the valve operating device 1, the charge exchange valve 2 is in active connection—with the interposition of a transfer element 3 having a wheel 5 turning about an axis 4—with a control track 6 comprising an idle stroke cam follower 6' and a lifting stroke cam follower 6", which is arranged in the area of the end of a lever 8 operated by a cam 7' of a camshaft 7 for producing the lifting stroke of the charge exchange valve 2. For a variable stroke adjustment of the charge exchange valve 2, the lever 8, which is associated with the cam 7' without free play by means of a spring 9, is supported along a circular path by a fulcrum 12 whose position can be varied by means of adjusting mechanism 11 and locked in place.

In order to achieve a purely rotary or purely rocking movement of the lever 8 about its pivot point 12 with a reduced stroke of the charge exchange valve 2, an arcuate path 14 arranged on a part 13 of the housing of the internal combustion engine (not shown) as a slide 15 with a radius "R" about the axis of rotation 4 of the wheel 5 of the transfer element 3 for the support at variable positions of the lever 8. Preferably, at its end remote from the control path the spring-loaded lever 8 thrusts with a wheel 17 rotating about an axis 16 against the arcuate path 14 or slide 15, and can be held in place by means of a cam 18 of the adjusting system 11 by the action of spring 9 such that the axis 16 of the wheel 17, which can be displaced along a line 19 equidistant from the circular path 14 or slide 15, forms the pivot point 12 of lever 8 serving in the particular variable valve lifting action.

With the invention it is advantageously brought about that the pivot point 12 of the lever 8 forms an invariable instantaneous center for a preset, reduced stroke and for any stroke during a particular lifting actuation.

With the invariable instantaneous center or pivot point 12 the linear movement components of the lever 8 mentioned in the introduction to the description are eliminated. In order in this case to securely prevent any shock originating from a valve action of the valve operating device 1 when the wheel 5 of the transfer element 3 passes from the idle stroke cam 6' to the lifting cam 6" of the control track 6 during a valve lift, the control track 6 of the lever 8 is formed according to the invention in the transition between idle stroke cam 6' and lifting cam 6" with a ramp 20 provided for a valve action in the valve operating device 1.

With this cinematically configured valve operating device 1 an actual zero stroke of the charge exchange valve 2 can be realized; also, the result is a greater reduction of the operating time with a change in the lifting of the charge exchange valve 2, delayed opening and closing in the case of partial valve operation are eliminated or considerably reduced, so that a greater maximum valve acceleration is advantageously achievable. Furthermore, an improved torque as well as greater torque is also the result at the full load of the internal combustion engine.

For the reduction of wear in the valve operating device 1 it is furthermore provided that the guide wheel or circular path wheel 17 of the lever 8 is mounted on needle or roller bearings on a non-rotating stub shaft affixed to the lever 8.

As it can be seen from the FIGURE, the cam follower 10 of the lever 8 is also mounted on needle bearings; the same applies to the wheel 5 of the transfer element 3.

As it can furthermore be seen in the FIGURE, the transfer element 3 is a wheeled idler arm 23 supported on the housing by a hydraulic valve clearance equalizing device 22, whose wheel 5 cooperates with a control track 6 of the lever 8, which has a ramp 20 designed substantially for a constant stroke velocity, having a maximum lift exceeding the maximum valve clearance.

The transfer element 3 can also conceivably be a valve tappet with a roller, and also a rocker arm with a mechanically adjusted valve clearance.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A valve operating device for the variable stroke control of a charge exchange valve of an internal combustion engine, in which the charge exchange valve, with the interposition of a transfer element having a wheel movable about an axis of rotation, is in active connection with a control path comprising an idle stroke cam and a lifting stroke cam follower in an end of a lever controlled by a cam of a camshaft to perform the stroke of the charge exchange valve, wherein the lever urged by a spring through a curved path and associated under spring bias with the cam is supported at the other end for variable stroke adjustment along a circular path through a center of rotation, variable in position and lockable, controlled by an adjusting device, wherein a circular track disposed on a part of the housing of the internal combustion engine serves as a slide with a radius around the axis of rotation of the wheel of the transfer element of the support of the lever at a controlled variable position, wherein the control path of the lever is configured in the area of transition between the idle stroke cam follower and the lifting stroke cam with a ramp designed for a valve clearance in the valve operating device.

2. The device according to claim 1, wherein that the spring-loaded lever thrusts at its end remote from the control track against the circular path or slide through a wheel which can rotate about an axis, and can be affixed by the adjusting device such that the axis of the wheel on the slide side which can be displaced under control along a line equidistant from the circular path forms the pivot point of the lever serving for the particular variable lift motion.

3. The device according to claim 2, wherein the slide or circular-path wheel of the lever is disposed on needle or roller bearings on a stub shaft attached non-rotationally to the lever.

4. The device according to claim 3, wherein a wheeled tappet supported on the housing on a hydraulic valve clearance compensating device is provided as a transfer element, and wherein the ramp of the control path, designed substantially for a constant lifting speed has a maximum lift exceeding the maximum valve clearance.

5. The device according to claim 3, wherein a tappet with a wheel serves as transfer element.

6. The device according to claim 3, wherein a valve lever with a mechanically adjusted valve clearance serves as transfer element.

7. The device according to claim 2, wherein a wheeled tappet supported on the housing on a hydraulic valve clearance compensating device is provided as a transfer element, and wherein the ramp of the control path, designed substantially for a constant lifting speed has a maximum lift exceeding the maximum valve clearance.

8. The device according to claim 2, wherein a tappet with a wheel serves as transfer element.

9. The device according to claim 2, wherein a valve lever with a mechanically adjusted valve clearance serves as transfer element.

10. The device according to claim 1, wherein a wheeled tappet supported on the housing on a hydraulic valve clearance compensating device is provided as a transfer element, and wherein the ramp of the control path, designed substantially for a constant lifting speed has a maximum lift exceeding the maximum valve clearance.

11. The device according to claim 1, wherein a tappet with a wheel serves as transfer element.

12. The device according to claim 1, wherein a valve lever with a mechanically adjusted valve clearance serves as transfer element.

* * * * *